United States Patent [19]

Ferguson

[11] 4,135,692

[45] Jan. 23, 1979

[54] HANGER DEVICE

[76] Inventor: William J. Ferguson, 9707 Welsh Rd., Brookville, Ohio 45309

[21] Appl. No.: 867,046

[22] Filed: Jan. 5, 1978

[51] Int. Cl.[2] ..... F21S 1/02; A44B 21/00

[52] U.S. Cl. ..... 248/317; 24/260; 248/228

[58] Field of Search ..... 248/228, 343, 317, 226.5, 248/72, 342; 24/73 B, 81 B, 259 R, 260

[56] References Cited

U.S. PATENT DOCUMENTS

| | | | |
|---|---|---|---|
| 444,603 | 1/1891 | Tirrill | 24/260 |
| 687,129 | 11/1901 | Davison | 24/260 |
| 2,058,102 | 10/1936 | Philipp | 24/260 |
| 3,601,862 | 8/1971 | Hargadon | 248/317 X |
| 3,743,228 | 7/1973 | Drab | 24/259 R X |
| 4,025,019 | 5/1977 | Jacobsen | 248/317 |
| 4,065,090 | 12/1977 | Mauney | 248/317 X |
| 4,074,885 | 2/1978 | Hacker | 248/317 |

*Primary Examiner*—J. Franklin Foss
*Attorney, Agent, or Firm*—Jerome P. Bloom

[57] ABSTRACT

A snap on type hanger useful for suspension of articles from an elevated or overhead support includes a resilient clamp having a slidable control member the operator element of which embodies a suspension device.

In the embodiment illustrated the clamp is a generally U-shaped element the leg portions of which are biased to provide that they are normally slightly convergent from their base to their projected extremities. The latter are cupped to provide anchor means facilitating their gripping opposite edge portions of a base support. The leg portions are threaded through parallel slots or apertures in a transversely disposed plate which provides the slidable control member. The transversely disposed plate is slidable between detented positions flexing the leg portions of the U-shaped element to open and close the clamp.

10 Claims, 5 Drawing Figures

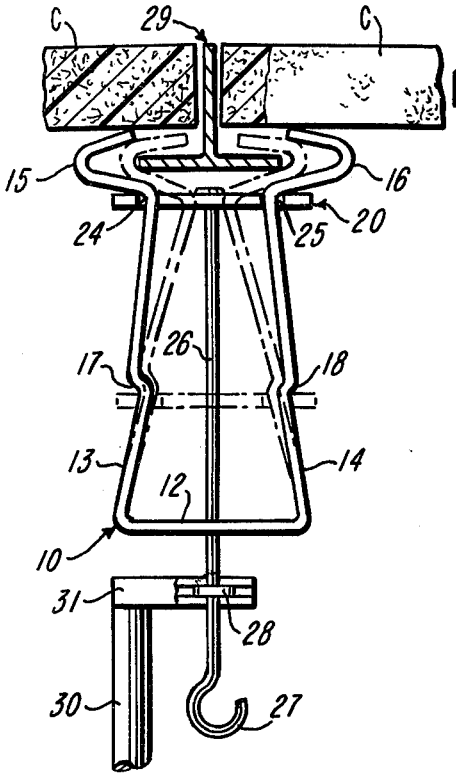
FIG-1
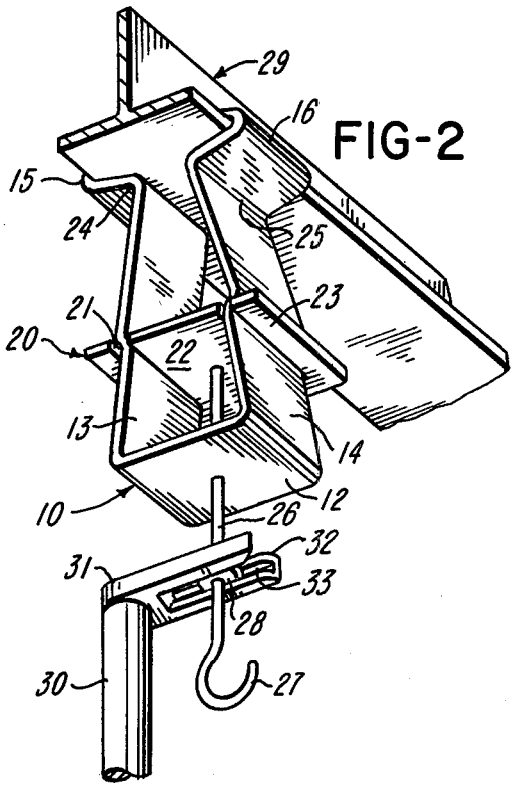
FIG-2
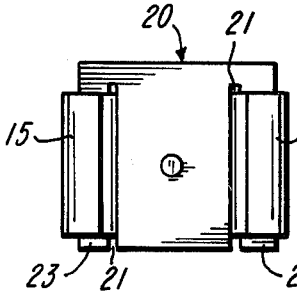
FIG-4
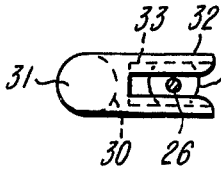
FIG-5
FIG-3
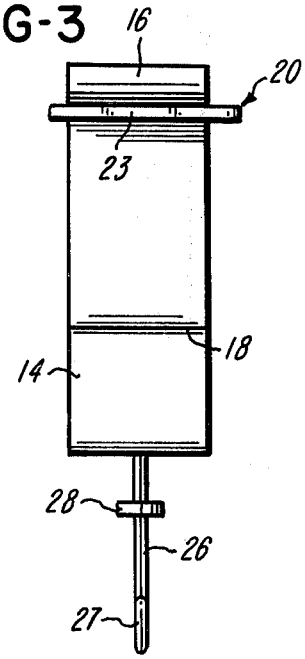

HANGER DEVICE

BACKGROUND OF THE INVENTION

This invention relates to a new and improved hanger device which can be easily applied to and removed from an elevated or overhead support. Embodiments are especially advantageous for application to supports which present relatively closely spaced parallel sides, such as, for example, a strip element forming part of a frame for a suspended ceiling. A preferred embodiment of the invention is herein described with reference to its use in connection with such a strip element. However this is only for purposes of illustration and not by way of limitation.

The hanger devices of the type with which the present invention is concerned are those such as may be used to suspend pots, baskets, tools, or for that matter a variety of articles the purpose of which is either ornamental or utilitarian. By far the great majority of such devices of the prior art require the use of screws or bolts for their attachment. In such event the structure to which they are applied is either permanently deformed or defaced and must be repaired when the hanger, and consequently its anchor device, is removed. There have been devices of the prior art which do not require the application of screws or bolts and are fabricated to slip, clip or loop over their support structures. However, such devices, in general, are not satisfactory in all respects. They are often times insecure as to their mount and give inadequate support. Those which have been designed to anchor to strip type supports such as employed in connection with suspended ceilings tend to distort or displace portions of the ceiling when applied. This last is, of course, highly objectionable.

The present invention provides embodiments of hanger devices useful in the suspension of pots, baskets, tools and other articles of substantial size and weight which are constructed and arranged not only to avoid the objectionable features of the prior art but to provide for their simple and economical fabrication, their more efficient and satisfactory use in a wide variety of applications and to avoid the deforming or defacing of the structure to which they are applied.

Prior art pertinent to the specific points of novelty herein set forth with reference to the present invention or its embodiments is unknown.

SUMMARY OF THE INVENTION

The present invention features a snap on type hanger device of the type such as might normally be used to suspend a basket, pot or like article from an overhead support. A particularly advantageous aspect of embodiments of the invention is that they may be applied from a remote location and to overhead locations which are normally inacessible absent the use of a ladder.

The embodiment of the invention herein illustrated by way of example comprises a U-shaped anchor element formed of sheet metal or equivalent material the configuration of which provides a pair of arms which are resiliently connected to and arranged to slightly converge in a sense outwardly from its base. The projected extremities of the arms are bent to define opposed anchoring means which are generally cup-shaped in cross section. A plate-like control member is mounted on and for movement longitudinally of the arms. This control member and the arms are respectively configured and arranged whereby to provide that the relative movement of the control member in one direction will bring the anchoring means together and the relative movement in the opposite direction will spread them apart. The control member has a rod-like operator in the case illustrated. This operator projects through and perpendicular to the base of the U-shaped member, in bearing relation thereto and mounts exteriorly thereof a hook-like device designed for suspension of an article from the hanger device, once the hanger device is appropriately secured to a base support. Connected with the operator is a projecting means which when engaged by the fingers, or remotely through the medium of an elongate control rod, may serve to transmit to the operator a push or pull force which is reflected in turn in the corresponding movement of the control member to achieve a desired positioning thereof and correspondingly a desired operation of said anchor element which, in effect, constitutes a clamp element.

As will be seen, not only is the anchor device a very simple structure and very simply operated by a pushing or pulling movement of the control member but it is so designed as to facilitate its application to remotely located base supports and in any case its application to a strip type base support without material displacement of any structure which might bear thereon and be supported thereby.

It is accordingly a primary object of the present invention to provide a hanger device which is simple to fabricate, efficient and satisfactory in use, adaptable to a wide variety of applications and unlikely to malfunction.

Another object of the invention is to provide a hanger device comprised of a clamp under the control of a bearingly mounted and longitudinally displaceable control member which facilitates the application of the hanger device to and the removal thereof from a base support.

A further object of the invention is to provide a new and improved hanger device having the ability to be applied to a base support without the need for screw or bolt type fasteners.

An additional object of the invention is to provide a hanger device which may be easily and effectively applied to relatively inaccessible locations and without material damage to the structure to which the same is applied.

Another object of the invention is to provide a hanger device comprised of a clamp embodying anchoring means wherein the clamp is controllable under the influence of an operator element, which embodies in connection therewith an article suspension means, and responsive to the application of a pushing or pulling force to the operator element.

An additional object of the invention is to provide a hanger or like device possessing the advantageous structural features, the inherent meritorious characteristics and the means and mode of use herein described.

With these and other incidental objects in view, as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention, FIG. 1 is an elevation view of a hanger device in accordance with the invention being applied to a strip element of a frame for an overhead ceiling and preliminary to a clamping engagement of the hanger device to the strip element;

FIG. 2 is a view of the apparatus of FIG. 1 showing the hanger device clamped to and in connection with the strip element which serves as its base support and also illustrating the manner in which a control rod may be applied to serve as a means for positioning and applying the hanger device from a location remote from the strip element;

FIG. 3 is a side elevation view of the hanger device;

FIG. 4 is a view of the hanger device taken from the anchor end thereof; and

FIG. 5 is a plan view of the end of the control rod illustrated in FIG. 2 used for remote application and removal of the hanger device when the same is required.

Like parts are indicated by similar characters of reference throughout the several views.

Referring to the drawings, the embodiment of the invention therein illustrated comprises a clamp 10, a slidable control member 20 and an operator rod 26 which incorporates a hook 27.

The clamp 10 is an elongate rectangular strip of sheet metal bent into a generally U-shaped configuration. A short central portion of the strip defines the base 12 of the "U" while equal end portions of the strip, bent on parallel lines transverse to the strip at either end of the base 12, are caused to project outwardly of the base in a slightly convergent relation, to thereby define its projected arms or legs 13 and 14. The material of which the clamp 10 is formed provides that the arms 13 and 14 are resiliently connected to the base 12 and to inherently bias towards each other to maintain, in absence of pressure, a predetermined relatively spaced relation of their projected extremities almost as wide as base 12.

On a line parallel to and in adjacent spaced relation to their base, each of the arms 13 and 14 is slightly offset from the other to respectively form a slight shoulder 17, 18 therein facing towards its base end. Beyond the shoulders 17, 18 the arms continue the convergence of their inner ends but in slightly offset parallel relation thereto.

The outermost end portions of each of the arms 13 and 14 are each first bent outwardly on a line 24, 25 transverse to the arm and at an angle slightly greater than 90° to the portion of the arm immediately inward thereof. Beyond the lines 24, 25 and at lines slightly more than half the distance therefrom to the projected extremities of the arms, each arm 13, 14 is bent inwardly towards the other to provide thereby that the projected extremities of the arms form cup-like anchoring portions, respectively 15 and 16, which open towards each other, are directly opposed and substantially V-shaped in cross section.

The control member 20 is a small rectangular plate having parallel slots 21 in respectively adjacent, spaced relation to each of opposite side edges of the plate. This positions the slots 21 to define therebetween a central portion of the plate which is substantially wider than those portions which lie outwardly thereof. In the assembly of the hanger device and before the formation of the anchoring portions 15 and 16, the projected extremities of the arms 13 and 14 are moved into and to extend through the slots 21. The mount of the plate 20 to the arms 13 and 14 provides a slip fit of the plate and, thereby, a relatively slidable control member the remote edges of the slots 21 of which bear on the remote outer broad surfaces of the arms. In such manner the relative spacing and separation of the arms and the anchoring portions is limited and controlled.

The operator rod 26 is a thin rod one end of which is fixed in connection with the plate defining the control member 20, at its center. From the control member 20 the rod 26 extends perpendicular to and through an aperture in the center of the base 12, beyond which its projected extremity is formed into a hook 27. Welded about and extending radial to the rod 26 between the base 12 and the hook 27 is a washer-like element 28 including parallel flats on its outer periphery, giving it an oblong configuration in plan view.

As seen in FIGS. 1, 2 and 5, a pole-like rod 30 is provided for control of the operator 26, at those times when the hanger device must be applied to a base support which is inaccessible in absence of a ladder. The operator engaging end of the rod 30 embodies a hook device 31 extending at right angles thereto. The device 31 is bifurcated by a slot directed inwardly of its outer end to form thereby lateral spaced fingers 32. At the facing sides thereof each finger 32 has a groove the length thereof which is generally rectangular in cross section. The grooves 33 are shaped and sized to have slip fit therein, by way of the outermost open ends thereof, the washer-like element 28 with the flatted portion thereof bridging the fingers and their flat edge portions bearing in the grooved portions of the fingers 32. The projected ends of the bifurcated fingers 32 are curved at their adjacent edges, in plan view, to provide an outwardly expanding mouth for the slot defined therebetween. This facilitates the application of the part 32 to accommodate the part 28 of the hanger device.

FIGS. 1 and 2 illustrate a portion of a strip 29 used in framing a dropped ceiling wherein strips 29, as seen in FIG. 1, are used to nest and support panels or segments C of ceiling material. As there seen the strips 29, in cross section have the shape of an inverted "T" the head of which provides oppositely projecting shoulders simultaneously supporting adjacent edge portions of ceiling panels C.

The installation of the hanger device above described is a very simple and quick procedure.

Having reference to the attached drawings and the example illustrated, it will be seen that on holding the clamp 10 and grasping the projected end of the rod 26 and effecting a pushing or pulling movement of the rod, the plate providing the control member 20 will be moved in a sense longitudinally of the arms 13 and 14. On pushing the rod 26 outwardly of the arms, the plate 20 will be moved to a detent position at a location defined by the lines 24, 25 wherein it essentially abuts innermost ends of the anchor portions 15 and 16. In this position of the plate 20 the anchor portions are spread sufficiently to have their projected extremities clear the lateral side edges of the head portion of the strip 29 to which the hanger device must be anchored. This enables a simple placement of the anchor portions of the clamp in respective positions where they can readily accept the remote side edge portions of the head of the strip as they are moved together. Thus, the hanger device is shown in FIG. 1 in a ready position, following which the clamp 10 can be rotated, slightly, about its central longitudinal axis to cause the projected extremities of the anchor portions to have end portions thereof in overlapping relation to the upper or innermost surface of the head of the strip. Once the rotation is effected, the overlapped anchor portions may be brought to rest on the upper or innermost surface of the head of the strip, thus establishing a reference plane limiting movement of the clamp 10 outwardly of the strip as the operator rod 26 is pulled outwardly to move the plate 20 inwardly of the arms 13 and 14 until they pass to the inner sides of the shoulders 17 and 18. In moving from the first to the second detent position, by reason of the containment of the outer surfaces of the arms 13 and 14 thereby, the plate 20 functions to bias the arms together and to squeeze the anchor portions 15 and 16 to opposite side edge portions of the head of the strip 29, in embracing relation thereto. The hanger device is firmly anchored by this simple manipulation. Particular attention is directed to the fact that as the control member (plate) 20 is moved inwardly and past the shoulders 17 and 18 there is a snap action movement of the arms by virtue of which the finger-like portions of the plate 20 outwardly of the slots 21 engage under the shoulders 17 and 18. This insures a positive and firm grasping of the base support (in this instance the head of the strip 29) by the anchor portions 15 and 16. A feature of the arrangement thus described is that as the rod 26 is pulled to displace the plate 20 in a sense inwardly of the arms 13 and 14 the anchor portions will automatically self align as they close upon the base support. This insures that they will be firmly and accurately positioned.

Where the base support or the part thereof to be engaged by the anchor portions cannot be fully cleared by the anchor portions after being spread as shown in FIG. 1 of the drawings, one can then move in the case illustrated to accommodate one edge of the base support in one of the anchor portions, following which the other anchor portion can be brought up and caused to overlap in part an opposite edge of the base support, whereupon the operator rod may be pulled to create a firm and automatic anchor of the hanger device to the base support.

As will be obvious, to remove the hanger device from the base support illustrated, one need only push the operator rod in a reverse direction to thrust the control plate 20 outwardly of the arms 13 and 14 and back to the first detent position illustrated, whereupon the hanger device may be cleared of and displaced from the base support in an obvious manner.

Where as in the case illustrated one desires to apply a hanger device to a ceiling area embodying a prospective base support, such as a strip 29, one can use the rod 30 to facilitate the placement of the hanger device, which would otherwise be in an area inaccessible except when using a ladder.

In this last respect, as may be seen, one can in the first instance take a hanger device per the present invention and slip the bifurcated portion 31 at one end of the rod 30 over the projection 28 in connection with the rod 26. As will be seen from FIG. 1 and FIG. 2 of the drawings, this is a relatively simple matter, the hook portion 31 being moved so the flatted sides of the element 28 will be accommodated in the grooves 33. As the element 28 which is an integral part of the operator rod 26 is firmly seated in the hook portion 31, the pole 30 may be grasped and with the arm extended can be moved to place the hanger assembly in a position such as illustrated in FIG. 1, in which position the outer projected extremities of the anchor portions 15 and 16 are positioned and lifted to slightly lift the adjacent edges of the ceiling panels C which overlie the inverted head of the strip 29. When the anchor portions are initially braced against the upper or innermost surface of the head of the strip 29 and the operator element 26 is pulled by pulling on the rod 30, the control plate 20 will be moved down with reference to the arms 13 and 14 until it passes into the second detent position previously referred to with reference to the clamp 10, immediately behind the shoulders 17 and 18. In this position the anchor portions are brought together in a closely embracing clamping relation to the remote side edges of the head of the strip 29. Particular attention is directed to the fact that the form of the anchor portions and the manner of their application provides that there is in fact very little displacement of the edge portions of the ceiling panels C which are superposed as the projected extremities of the anchor portions are interposed between the ceiling segments and the strip 29. The plate material of which the clamp is formed and the narrow V-shaped cross section of the anchor portions is designed to this end. The arrangement is such as to inhibit any particular damage to the ceiling sections in the process of the application of the anchor portions of the clamp 10.

It will be seen from the foregoing that one may easily manipulate the hanger device with the fingers of one's hands or, if the hanger device must be placed in a remote location, one can mount the hanger device in connection with the rod 30, for movement thereby to any place desired, including places quite remote from the position at which the person handling the rod may stand.

It may accordingly be seen that the embodiment of the invention may be quite simply fabricated and operated, utilizing a push-pull procedure. Though the hanger device of the invention is shown in a preferred embodiment and utilizing preferred configurations of the anchor portions, the anchor portions may obviously be configured in different manner, depending on the range of application desired. In any case the hanger device of the invention is unlikely to result in defacing or damaging of the base supports to which it may be applied or, for that matter, any structure mounted on the base supports. Further the device of the invention in its various possible embodiments need not be limited in its application to ceiling strips or supports of the nature disclosed. As a matter of fact, the embodiment illustrated may be applicable to any base support which offers opposite side edge portions of a part thereof to which the anchoring means may be engaged.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A hanger or like device for quick attachment to and release from a support structure including a U-shaped member comprised of a base and relatively projected arms, the projected extremities of the latter of which provide opposing cup-shaped anchoring means, said arms being flexible with respect to said base to provide for relative separating and approaching motions of said anchoring means, a plate element having slots through which said arms are projected, said plate element being movable longitudinally along said arms toward and away from said projected extremities thereof, said arms in extending through said slots in said plate element assuming a convergent relation to one another whereby a motion of said plate element toward said projected extremities effects a separating motion of said cup-shaped anchoring means and a motion of said plate element away from said projected extremities effects an approaching motion of said cup-shaped anchoring means, said U-shaped member defining a clamp opened and closed with respect to a support structure by a relative separating and approaching motion of said anchoring means, and an article suspension means extending from said clamp in a connected relation to said plate element, said suspension means being accessible to be pulled and pushed to fix said clamp and to free said clamp relative to the support structure.

2. Apparatus as in claim 1, wherein said arms are formed to provide longitudinally spaced apart detent positions engageable by said plate element in positions defining open and closed positions of the clamp respectively, the form of said arms and the relationship thereof to said plate element being such to provide that the movement of said plate element between said detent positions produces a snap action closing or opening of said clamp.

3. A hanger device for suspending loads from an overhead support, including flexible means forming a clamp having open and closed positions, a slidable control member in a containing relation to and movable relative to said means forming a clamp to effect and control flexing movement thereof to open and close said clamp, said slidable control member being part of a means for suspending a load and being accessible from beneath said device for pushpull movements opening and closing the clamp, the weight of a suspended load being applied to said control member in a direction to close said clamp.

4. A hanger device according to claim 3, wherein said means forming a clamp provides anchoring means at an upper end thereof, said anchoring means including longitudinally spaced apart abutment portions reactant upon an engaged support structure to allow said clamp to be opened and closed working entirely from beneath said device utilizing simple push-pull movements applied to said slidable control member.

5. A hanger device according to claim 4, wherein said means forming a clamp comprises a U-shaped member providing a base portion and relatively flexible arms upstanding therefrom, outer ends of said arms providing opposing relatively recessed configurations each including spaced apart surfaces defining said abutment portions.

6. A hanger device according to claim 3, wherein said means forming a clamp comprises a U-shaped member providing a base portion and relatively flexible arms upstanding therefrom, said slidable control element being plate-like and orienting substantially parallel to said base portion, said means for suspending a load including rod means attaching to said plate-like element and extending to and through said base portion where an end thereof is presented for suspension of a load and for gripping to push and to pull said plate-like element longitudinally of said arms.

7. A hanger device according to claim 6, wherein outer ends of said arms form opposing anchoring means, said plate-like element having laterally spaced apart slots through which said arms are projected, said plate-like element being slidable along said arms between said base portion and said anchoring means, said arms in extending from said base portion through the slots in said plate-like element assuming a convergent relation to one another whereby a movement of said plate-like element toward said anchoring means effects a relative separating motion thereof and movement of said plate-like element toward said base portion effects a relative approaching motion of said anchoring means, separating and approaching motions of said anchoring means defining opening and closing actions of the clamp.

8. A hanger device according to claim 7, wherein a movement of said plate-like element toward said base portion enforces a relative approaching movement of said arms, said arms having an inherent bias against such movement, and said arms at locations relatively near to said base portion each having an offset shoulder, said plate-like element upon being pulled toward said base portion to a position under said shoulders being detented thereby to hold the clamp yieldingly in a closed position.

9. A hanger device according to claim 8, wherein upon said plate-like element pushed away from a detented position under said shoulders said arms are freed for a snap action release of said clamp from a closed position to an open position.

10. A hanger device according to claim 9, wherein anchoring means at the outer ends of said arms include laterally outwardly protruding portions defining a stop for said plate-like element against which said element limits in its movement to define an open position of said clamp.

* * * * *

UNITED STATES PATENT AND TRADEMARK OFFICE

CERTIFICATE OF CORRECTION

PATENT NO. : 4,135,692

DATED : January 23, 1979

INVENTOR(S) : William J. Ferguson

It is certified that error appears in the above-identified patent and that said Letters Patent are hereby corrected as shown below:

Col. 8, line 45 (Claim 9, line 2), -- being -- is inserted following "element".

Signed and Sealed this

*Eighth* Day of *May 1979*

[SEAL]

*Attest:*

RUTH C. MASON
*Attesting Officer*

DONALD W. BANNER
*Commissioner of Patents and Trademarks*